US005094922A

United States Patent [19]

Ielpo et al.

[11] Patent Number: 5,094,922

[45] Date of Patent: Mar. 10, 1992

[54] BIMETALLIC COIN BLANK, PARTICULARLY FOR COINS AND THE LIKE

[75] Inventors: Nicola Ielpo, Rome; Piero Patarini, Aosta, both of Italy

[73] Assignees: Istituto Poligrafico E Zecca Dello Stato, Rome; Verres S.R.L. Societa Per La Monetazione E Fonderia Di Precisione, Verres, both of Italy

[21] Appl. No.: 572,642

[22] Filed: Aug. 27, 1990

[30] Foreign Application Priority Data

Sep. 1, 1989 [IT] Italy ..... 48320 A/89

[51] Int. Cl.[5] ..... A44C 21/00

[52] U.S. Cl. ..... 428/579; 428/609; 40/27.5

[58] Field of Search ..... 428/579, 600, 609; 40/27.5

[56] References Cited

U.S. PATENT DOCUMENTS

| | | | |
|---|---|---|---|
| 309,439 | 12/1884 | Chillingworth et al. | 428/609 |
| 632,938 | 9/1899 | Greenburg | 40/27.5 |
| 2,331,636 | 10/1943 | Stone | 40/27.5 |
| 2,983,354 | 5/1961 | Embor et al. | 40/27.5 |
| 3,499,739 | 3/1970 | Segel | 428/579 |
| 4,472,891 | 9/1984 | Ielpo | 428/579 |

FOREIGN PATENT DOCUMENTS

| | | | |
|---|---|---|---|
| 191288 | 6/1937 | Switzerland | 40/27.5 |

*Primary Examiner*—John Zimmerman
*Attorney, Agent, or Firm*—Browdy and Neimark

[57] ABSTRACT

A coin blank, particularly for minting of coins and the like, is formed by an external element of metal or metal alloy having a central aperture, on the edge surface of which are cut perimetrally a series of spaced grooves, and by an internal element, of metal or metal alloy different from the former, on the edge surface of which is formed a perimetral ridge, said external and internal elements being coupled inseparably during the minting operation through the plastic flow of the material from said perimetral ridge into said grooves in said external element and through the firm fitting of the material from said ridge into the portions of the edge surface of said central aperture in said external element, provided between adjacent grooves.

4 Claims, 4 Drawing Sheets

FIG.1A.
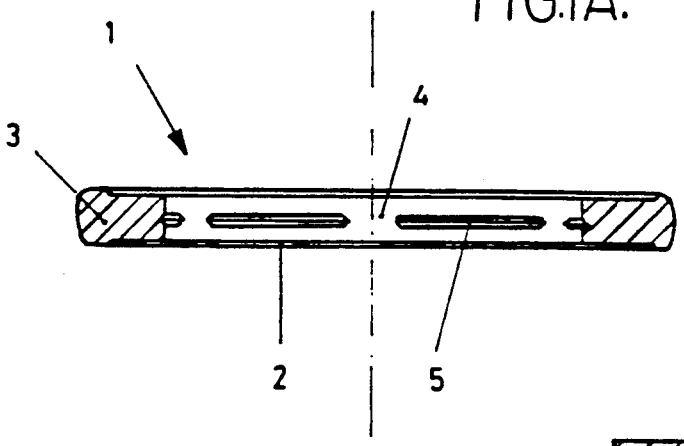
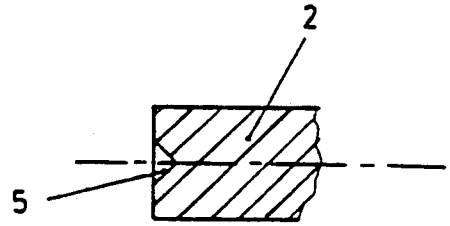
FIG.1C.
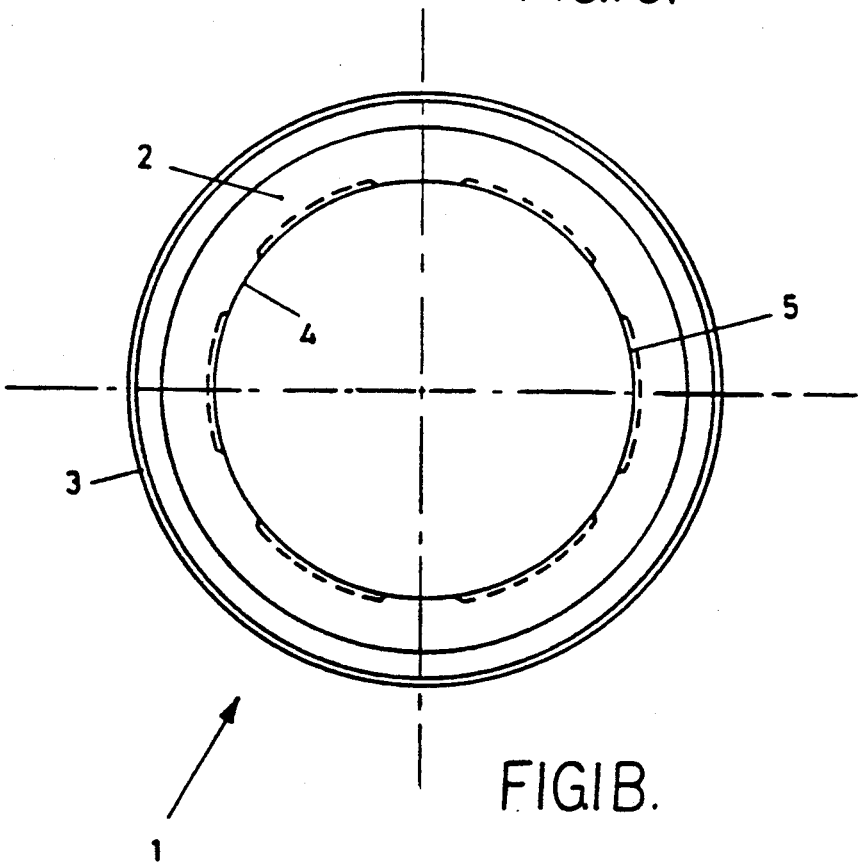
FIG.1B.

FIG. 2A.
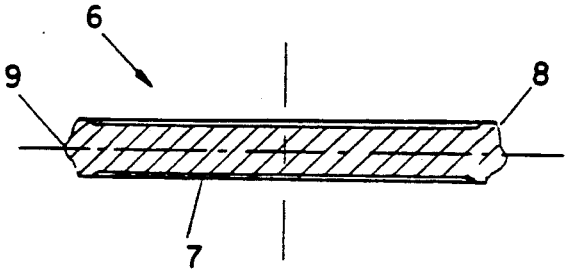
FIG. 2B.
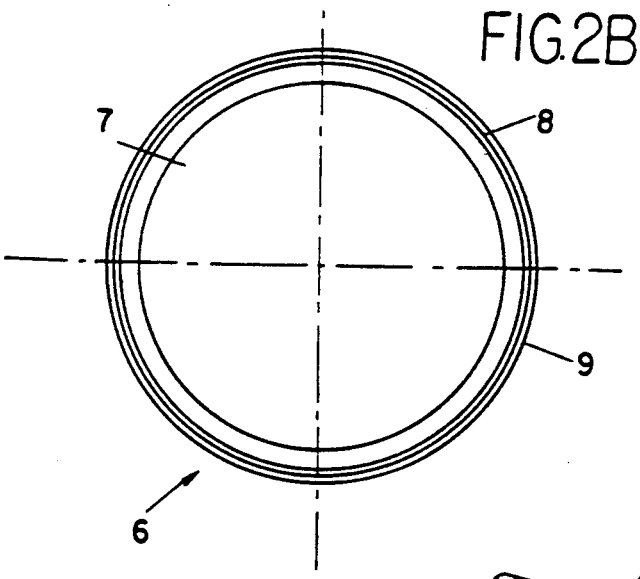
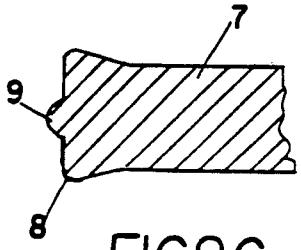
FIG. 2C.

BIMETALLIC COIN BLANK, PARTICULARLY FOR COINS AND THE LIKE

BACKGROUND OF THE INVENTION

1. Field of Invention

The present invention refers to a coin blank, particularly for coins and the like, formed by one external and one internal part, each of a different metal or metal alloy, made integral one with the other.

2. Description of the Prior Art

At present, various combinations of bimetallic coin blanks of the above kind are known in the art, used for minting of coins, medals, tokens and the like, which however do not provide sufficient reliability with regard to coupling of the respective internal and external parts.

SUMMARY OF THE INVENTION

Therefore, an object of the present invention is to provide a bimetallic coin blank, particularly for coins and the like, comprising an external element having a central aperture and an internal element of a shape complementary to the central aperture of said external element, said elements being coupled together by means of a system capable of ensuring a considerable degree of attachment.

BRIEF DESCRIPTION OF THE DRAWINGS

The present invention will be illustrated in greater detail hereinbelow with reference to a preferred embodiment thereof, given merely as an example and not limitative, with reference to the attached drawings, in which:

FIGS. 1A, B are respectively a cross-section and plan view of the external element of the proposed bimetallic coin blank, and FIG. 1C is an enlarged scale, cross-section view, of a detail of the same;

FIGS. 2A, B are respectively a cross-section and plan view of the internal element of the proposed bimetallic coin blank, and FIG. 2C is an enlarged scale, cross-section view of a detail of the same;

DESCRIPTION OF A PREFERRED EMBODIMENT

Figure 3:
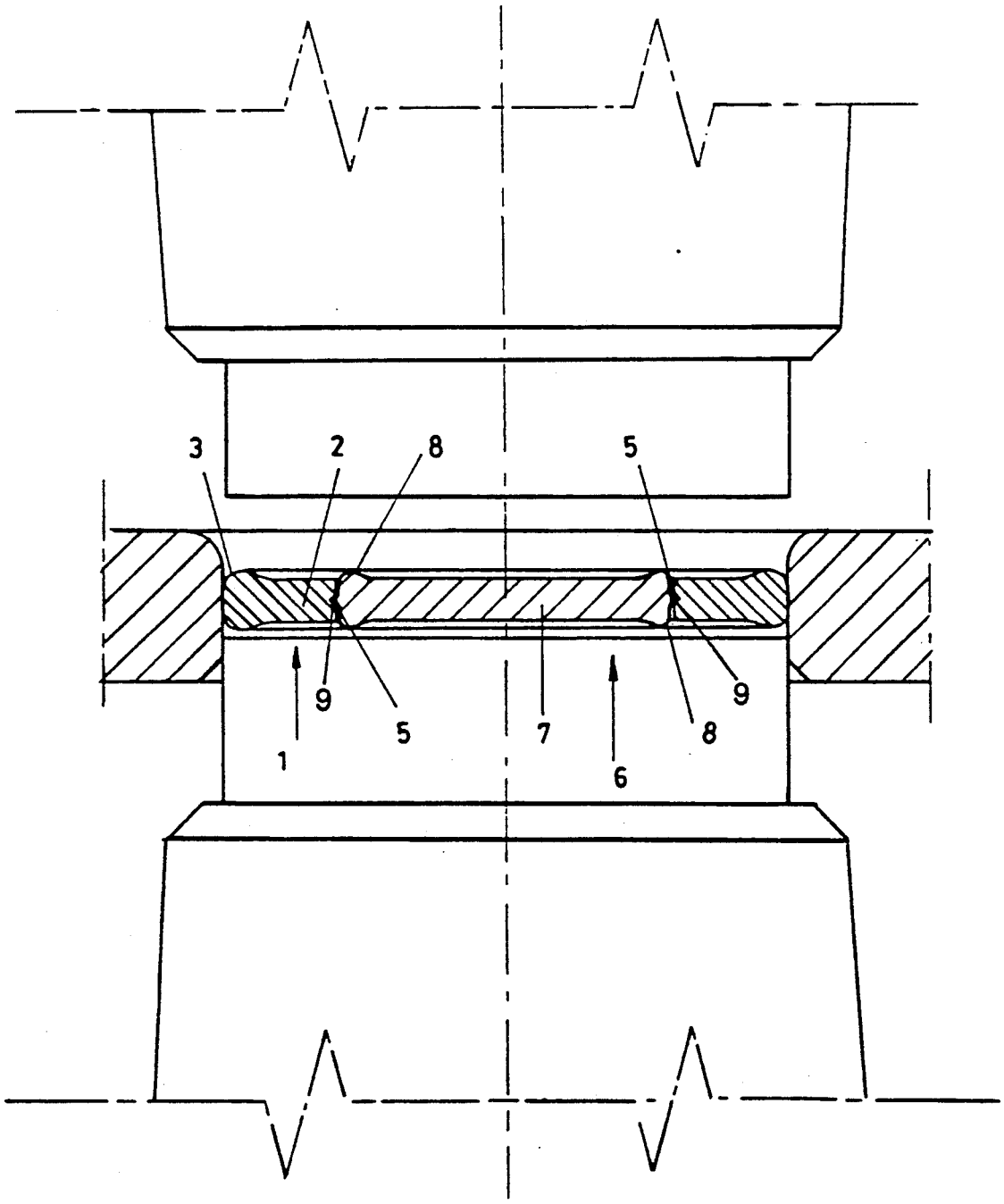
FIG. 3 is a cross-section view of the external element of FIG. 1 and the internal element of FIG. 2 of the proposed bimetallic coin blank positioned in a schematically shown coin press.

In FIG. 1, the external element of the bimetallic coin blank of the present invention, which is used for minting of coins in the present embodiment, is generically referred to in 1.

The external element 1 comprises a circular annular body 2 of metal or metal alloy with a thickened external perimetral edge 3 and an internal perimetral edge 4 delimiting a central circular aperture.

According to the present invention, within the thickness of the internal perimetral edge 4 of the annular body 2 are formed a series of circumferentially equidistant grooves 5, of predetermined shape and number, as needed.

In FIG. 2, the internal element, generally referred to in 6, of the bimetallic coin blank according to the invention, is shown in the above mentioned drawings, said element comprising a circular body 7 of metal or metal alloy different from that used for the external element 1, having a thickened external perimetral edge 8 and a circumferential ridge 9, the diameter of the circular body 7 being substantially equal to the diameter of the central aperture of the circular annular body 2.

Figure 4:
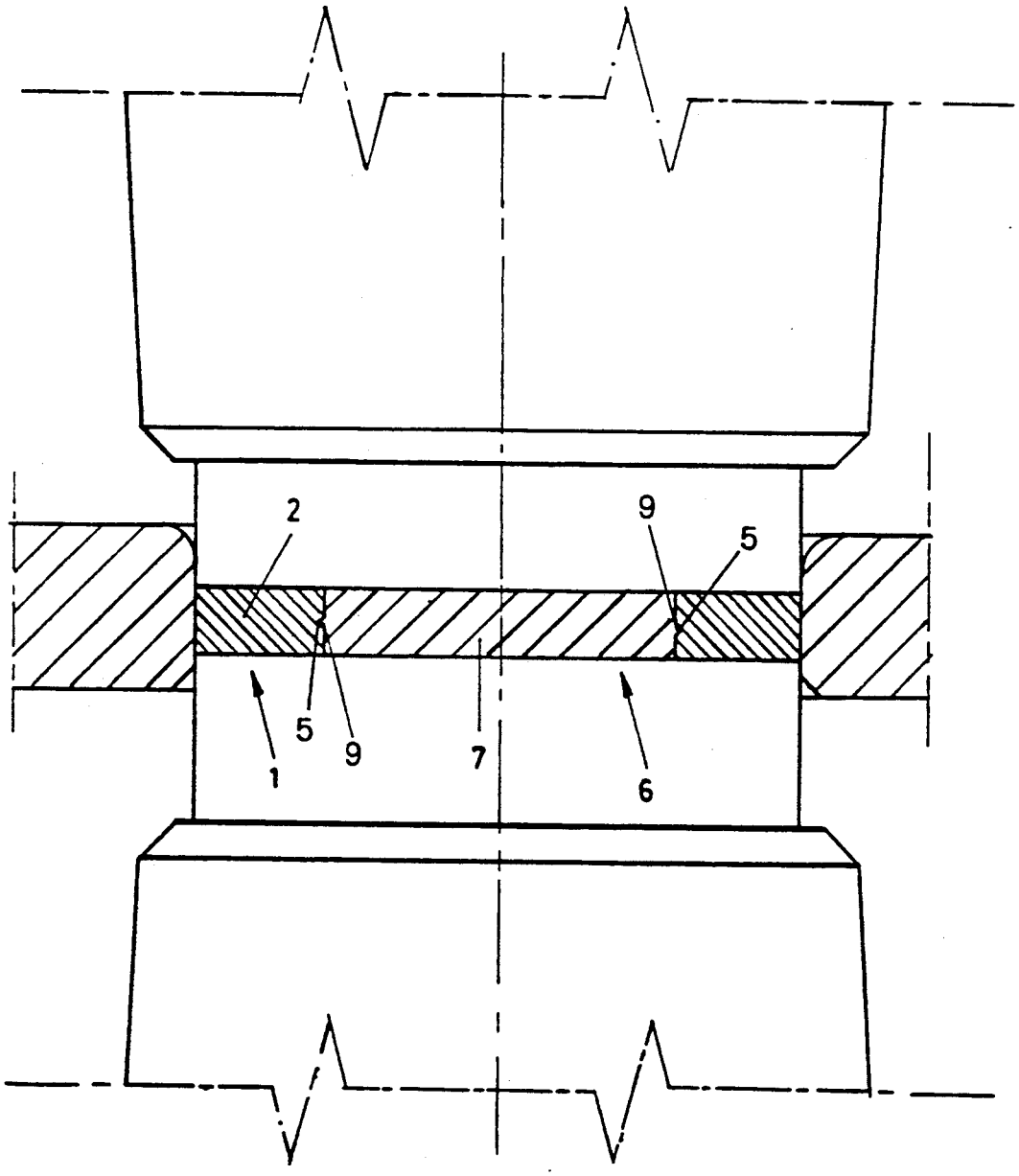
FIG. 4 is a cross-section view of the proposed bimetallic coin blank after the forced coupling of the external and internal elements of FIGS. 1 and 2, respectively, following the coining operation using the coin press in FIG. 3.

In order to form the coin blank of the present invention in an integral manner, the external element 1 and the internal element 6 are positioned in a conventional coin press, as illustrated schematically in FIG. 3, where they undergo the minting operation which joins them inseparably. In fact, during the above mentioned operation, the strong pressure exerted by the minting cones on the two faces of the coin blank causes said elements to undergo a squashing action during which, as can be seen in FIG. 4, the internal circular body 7 expands to a greater extent than the external annular body 2, held in the ferrule of the press, so that the material from the portions of the ridge 9 which are in correspondence with the grooves 5 in the internal perimetral edge 4 of the annular body 2 fill the latter by plastic flow, while the material from the remaining portions of the ridge 9 is firmly fitted into the respective portions of the internal perimetral edge 4 of the annular body 2 comprised between adjacent grooves 5, thus causing a strong attachment of the external element 1 and the internal element 6.

Therefore, the resulting forced coupling is such that it leaves no degree of freedom for reciprocal movement to the elements forming the bimetallic coin blank of the invention, either in an axial or in a rotational direction.

Although in the example of the embodiment described above the use of the bimetallic coin blank according to the present invention refers to the minting of metal coins in which both the internal and the external element are of circular shape, the invention may be used for other similar applications, for example the production of medals and the like, comprising the modification of the shape of one or both the components, obviously as long as the external contour of the internal element corresponds to the contour of the internal aperture of the external element.

Therefore the present invention is not limited to the embodiment of the example described but comprises any variation of execution thereof.

We claim:

1. A bimetallic coin bank for coins comprising: an external element having a central aperture made of a first metal or metal alloy; and an internal element made of a second metal or metal alloy different from the first, the contour of which is the same as the contour of said central aperture of said external element; said bimetallic coin blank being characterized by the fact that said external element has an edge delimiting said central aperture in which are cut a series of perimetrally spaced grooves to allow material of said internal element to plastically flow into them following a compression operation on said external element when coupled.

2. Bimetallic coin blank according to claim 1, wherein, on the surface of the edge of said internal element is a perimetral ridge so that, following said compression operation on said coupled internal and external elements, the material from portions of said ridge which are in correspondence with those of said grooves flows plastically into said grooves, while material from remaining portions of said ridge is firmly fitted into portions provided between adjacent grooves.

3. Bimetallic coin blank according to claim 1, in which said external element and said internal element each have thickened external perimetral edges.

4. Bimetallic coin blank according to claim 1, in which said compression operation on said coupled internal and external elements is performed during a minting step said bimetallic coin blank in a coin press.

* * * * *

UNITED STATES PATENT AND TRADEMARK OFFICE

CERTIFICATE OF CORRECTION

PATENT NO. : 5,094,922

DATED : Mar. 10, 1992

INVENTOR(S) : IELPO et al.

It is certified that error appears in the above-identified patent and that said Letters Patent is hereby corrected as shown below:

Column 2, Claim 1, Line 61, delete "element" and insert therefore --and internal elements---; and Column 3, Claim 4 Line 3, delete "step said" and insert therefore --step of said--.

Signed and Sealed this

Sixteenth Day of November, 1993

Bruce Lehman

*Attest:*

BRUCE LEHMAN

*Attesting Officer*

*Commissioner of Patents and Trademarks*